US010926157B2

(12) United States Patent
Mayrhofer et al.

(10) Patent No.: US 10,926,157 B2
(45) Date of Patent: Feb. 23, 2021

(54) CLIMBING AID, SKI AND METHOD FOR PRODUCING A CLIMBING AID

(71) Applicant: FISCHER SPORTS GMBH, Ried/Innkreis (AT)

(72) Inventors: Heinz Mayrhofer, Waldzell (AT); Christian Plomberger, Frankenmarkt (AT)

(73) Assignee: Fischer Sports GmbH, Ried/Innkreis (AT)

( * ) Notice: Subject to any disclaimer, the term of this patent is extended or adjusted under 35 U.S.C. 154(b) by 324 days.

(21) Appl. No.: 15/972,706

(22) Filed: May 7, 2018

(65) Prior Publication Data

US 2018/0250579 A1 Sep. 6, 2018

Related U.S. Application Data

(62) Division of application No. 14/779,195, filed as application No. PCT/AT2014/050069 on Mar. 20, 2014, now abandoned.

(30) Foreign Application Priority Data

Mar. 22, 2013 (AT) ..... A 50196/2013

(51) Int. Cl.
*A63C 7/02* (2006.01)
*A63C 7/08* (2006.01)
*A63C 5/12* (2006.01)

(52) U.S. Cl.
CPC ..... *A63C 7/08* (2013.01); *A63C 5/12* (2013.01); *A63C 7/02* (2013.01)

(58) Field of Classification Search
CPC .... A63C 7/02; A63C 7/06; A63C 7/08; A63C 5/0422; A63C 5/0417; A63C 5/044; A63C 5/0428; A63C 17/1436
See application file for complete search history.

(56) References Cited

U.S. PATENT DOCUMENTS 2,142,459 A * 1/1939 Saby ..... A63C 5/0428 280/604
2,168,144 A * 8/1939 Wennerstrom ..... A63C 5/0428 280/604

(Continued)

FOREIGN PATENT DOCUMENTS

AT 12 128 U1 * 11/2011
AT 12128 U1 11/2011
CH 162175 A 6/1933
DE 8205601 U1 8/1982

(Continued)

*Primary Examiner* — Emma K Frick
(74) *Attorney, Agent, or Firm* — Laurence A. Greenberg; Werner H. Stemer; Ralph E. Locher

(57) ABSTRACT

A climbing aid for a ski has a plane base element which is connected on the inner side to a fastener to be detachably fastened to a running surface of the ski and which is connected on the outer side to backwards-slipping prevention elements acting contrary to a direction of travel. A flexible plastic support material forms the base element, and the backwards-slipping prevention elements are integrally formed with the plastic support material. In lateral regions, the base element has backwards-slipping prevention elements with push-off wings positioned obliquely to the direction of travel and, in the central region, has backwards-slipping prevention elements with push-off wings arranged substantially perpendicular to the direction of travel. The push-off wings of the backwards-slipping prevention elements of a first type are of lesser length and/or of lesser height than the push-off wings of the backwards-slipping prevention elements of a second type.

17 Claims, 9 Drawing Sheets

(56) References Cited

U.S. PATENT DOCUMENTS 2,914,335 A * 11/1959 Rivard ..... B63B 32/20 280/604
2,969,760 A * 1/1961 Eddy ..... B63B 1/20 114/291
3,858,894 A * 1/1975 Ver ..... A63C 5/0428 280/604
3,874,315 A * 4/1975 Wright ..... B63B 1/38 114/67 A
4,118,050 A * 10/1978 Schnurrenberger . A63C 5/0428 280/604
4,223,909 A * 9/1980 Danner ..... A63C 5/0428 280/604
4,320,908 A * 3/1982 Ellingsen ..... A63C 7/06 280/604
4,323,265 A * 4/1982 Benner ..... A63C 5/0428 280/604
4,359,077 A * 11/1982 Staufer ..... B23D 5/00 144/371
4,406,478 A * 9/1983 Staufer ..... B23D 5/00 280/604
4,431,209 A * 2/1984 Volkl ..... A63C 7/06 280/604
4,440,418 A * 4/1984 Staufer ..... A63C 5/04 280/604
D282,387 S * 1/1986 Pichler ..... D21/766
4,705,290 A * 11/1987 Gratz ..... A63C 5/0428 280/604
4,919,447 A * 4/1990 Jackson ..... A63C 5/0428 280/604
5,344,177 A * 9/1994 Rouser ..... A44B 18/0053 24/584.1
5,725,237 A * 3/1998 Krafft ..... A63C 5/044 280/609
5,727,807 A * 3/1998 Krafft ..... A63C 5/044 280/608
6,659,492 B2 * 12/2003 Gousie ..... A63C 5/00 280/604
6,772,542 B2 * 8/2004 Jacobson ..... A63C 7/06 280/600
7,543,839 B2 * 6/2009 Hartmann ..... A63C 7/04 280/604
8,317,217 B2 * 11/2012 Zemp ..... A63C 7/02 280/604
8,925,956 B1 * 1/2015 Harkin ..... A63C 13/003 280/604
2006/0038365 A1 * 2/2006 Halfacree ..... A63C 5/044 280/14.21
2016/0361622 A1 * 12/2016 Puget ..... A63C 5/02
2017/0120136 A1 * 5/2017 Shute ..... A63C 7/02

FOREIGN PATENT DOCUMENTS

DE 8325866 U1 2/1984
DE 8422010 U1 10/1984
EP 2452729 A1 5/2012
FR 1170272 A 1/1959
WO 8908481 A1 9/1989
WO 2008046119 A1 4/2008

* cited by examiner

CLIMBING AID, SKI AND METHOD FOR PRODUCING A CLIMBING AID

CROSS-REFERENCE TO RELATED APPLICATION

This application is a divisional of patent application Ser. No. 14/779,195, filed Sep. 22, 2015; which was a § 371 national stage filing of international application No. PCT/AT2014/050069, filed Mar. 20, 2014, which designated the United States; this application also claims the priority, under 35 U.S.C. § 119, of Austrian patent application No. AT A50196/2013, filed Mar. 22, 2013; the prior applications are herewith incorporated by reference in their entirety.

BACKGROUND OF THE INVENTION

Field of the Invention

The invention relates to a climbing aid for a ski, in particular a touring ski, comprising a plane base element which is connected on the inner side to fastening means in order to be detachably fastened to a running surface of the ski and which is connected on the outer side to backwards-slipping prevention elements acting contrary to a direction of travel, wherein a flexible plastic support material is provided as a base element, and the backwards-slipping prevention elements are integrally formed with the plastic support material, and to a ski having such a climbing aid.

The invention further relates to a method for producing a climbing aid for a ski, in particular a touring ski, wherein a plane base element is connected on the inner side to fastening means in order to be detachably fastened to a running surface of the ski and is connected on the outer side to backwards-slipping prevention elements acting contrary to a direction of travel.

During ski touring, so-called climbing skins are usually used as a climbing aid. The climbing skins are applied on the running surface of the ski. Usually, the back of the skins is provided with a flexible adhesive glue which is connected with the running surface of the ski. In this condition climbing is performed. Prior to downhill running, the skins are removed, possibly covered by a thin film on the side coated with the glue, and folded.

Such a climbing skin and a method for producing same are, for instance, known from European patent EP 2 000 182 A1. The climbing skin comprises a support layer to which a pile of fibers is fastened. The fibers may be a mono filament or a multi filament.

The known climbing aids basically work in a satisfactory manner, but they have some disadvantages. Due to the complex structure their production is relatively cost-intensive.

Furthermore, the skins are relatively heavy. The substantial disadvantage of the climbing skins, however, consists in that the climbing skins, in certain snow conditions, tend to balling, which means to the forming of clots of snow and ice. If, at the beginning of a ski tour in lower altitude, very moist snow conditions exist, the fibers of the climbing skins are soaked. During climbing the temperature decreases, having as a consequence that the snow cover transitions to a so-called dry snow. This dry snow may adhere in the form of ice to the moist and/or soaked climbing skin, which may entail the balling mentioned, and which may greatly aggravate the further climbing.

Moreover, flexible climbing aids of plastic in which backwards-slipping prevention elements are formed have already been proposed in the state of the art. The design of the backwards-slipping prevention elements of these climbing aids has, however, proved little satisfactory for touring skis, so that the known plastic climbing aids could not establish themselves. In practice it was observed in particular that such climbing aids either had too high sliding resistance or did not offer sufficient hold in the case of hillside crossing.

German utility model DE 83 25 866 U1 discloses a band-shaped climbing aid device which can be fastened to a ski by means of loops; alternatively, however, an adhesive layer may also be provided. The climbing aid device comprises, on the useful surface facing away from the running surface layer, a saw tooth structure with undercuts, so that the climbing aid slides better on snow in the one direction than in the opposite direction. This climbing aid, however, does not offer sufficient slip prevention in the case of climbing routes with hillside crossing.

Published, Chinese patent application CH 162175 A provides a slip prevention strip for skis which can be rolled up and which is to replace the climbing skins known. The slip prevention strip is made of rubber, wherein barb-type slip prevention means are provided which consist of a piece of the lower surface and scarcely prevent forward sliding, but are to prevent backward slipping. In one embodiment the slip prevention comprises slip prevention means on both sides which protect from backward slipping with the one face and from sideward slipping with the other face. In practice, however, no satisfactory results could be achieved with such slip prevention means, either.

German utility model DE 84 22 010 U1 describes another climbing aid consisting of a band which is provided with backward-directed lamellas on a side facing the ground. The lamellas and the band may be manufactured integrally of plastic. The climbing aid is applied to the ski by means of an adhesive layer on the upper side of the band. The lamellas are formed in a scale-like manner in rows, wherein the rows are arranged in the form of a circular arc. It is, however, a disadvantage with this lamella-type design that moist snow may accumulate in the covering lamella gaps—similar to the classical climbing skin—and may easily become ice as the temperature changes during climbing. Such icing-up produces a high decelerating effect, so that climbing is correspondingly aggravated.

Published, French patent application FR 1 170 272 A discloses another slip prevention aid which can be detachably fastened to a ski and which is produced of a rubber material. This results in flexibility of the slip prevention aid which comprises at its underside tongue elements preventing backward slipping. The arrangement of the tongue elements on the slip prevention aid, however, also entails the aforedescribed disadvantage that sufficient slip prevention cannot be achieved in the case of hillside crossing.

German utility model DE 82 05 601 U1 describes another climbing aid which may be formed by a rubber part or an elastic plastic part. Elasticity is such that the climbing aid can be hooked in on the ski by means of eyes and hooks. On the other hand, however, gluing to the ski is also conceived. The climbing aid comprises saw tooth-like elevations on the underside. This climbing aid is also subject to the aforedescribed restrictions.

Furthermore, climbing aids in the form of ski crampons are known in the state of the art. AT 12 128 U1 illustrates such a climbing aid which is produced of a hard, rigid material, in particular inert steel or plastic. The climbing aid comprises lateral steel bands. Moreover, resistance lamellas are provided. This climbing aid is fastened in the binding region by means of textile or plastic bands which are provided with hook-and-loop fasteners. Such climbing aids of hard, rigid material are especially suited for climbing on icy ground. For lengthy climbing on snow the ski crampons are not suited, though. Moreover, such climbing aids cannot be adapted to the ski geometry.

Moreover, langlauf skis are known in the state of the art in which a scale-like region is provided in the central region. European patent EP 0 592 384, for instance, discloses a langlauf ski in which the scale-like region serves as a push-off aid in order to prevent backwards slipping during the langlauf step. Such a backwards slipping aid can, however, not be used for touring skis since touring skis are provided with steel edges, so that the region preventing backwards slipping would be positioned between the steel edges and thus could not press itself sufficiently into the snow surface.

Another example of a different langlauf ski is described in U.S. Pat. No. 4,919,447 A.

BRIEF SUMMARY OF THE INVENTION

It is an object of the invention to provide a climbing aid of simple construction which can be produced in a cost-efficient manner and by which the disadvantages of known climbing aids are eliminated or at least mitigated. Accordingly, the particular aim of the invention is to provide a climbing aid which cares for sufficient hold on the ground in the case of changing snow conditions and in the case of hillside crossing.

For solution of this object, a climbing aid, a ski, and a method with the features of the main claims are provided. Preferred embodiments are indicated in the dependent claims.

The base element of the climbing aid is a flexible plastic support material, wherein the backwards-slipping prevention elements are formed integrally with the plastic support material. Accordingly, the plane base element of the climbing aid consists of a flexible plastic support material which comprises a profile with the backwards-slipping prevention elements on the side facing the snow. This design guarantees optimum hold on the ground even in the case of changing snow conditions, wherein the production of clots on the side facing the snow, also referred to as balling, is largely prevented. The plastic support material with the backwards-slipping prevention elements has substantially less tendency to wetting with water than the known climbing skins, so that the soaking of the fibers which is a problem in the state of the art with respect to balling is avoided. Thus, sufficient slip prevention can even be ensured if the snow conditions during climbing vary due to the prevailing temperature and weather conditions. The backwards-slipping prevention elements are here, other than the fibers of the climbing skins, arranged substantially immovably on the plastic support material, wherein a certain deformability exists, of course, due to the inherent elasticity of the plastic material. Due to the flexibility of the plastic support material the handling of the climbing aid advantageously corresponds to that of climbing skins, so that the climbing aid can be fastened to the ski or be detached from it in the usual manner. For the purposes of the instant disclosure, a material sheet of plastic is meant to be the flexible plastic support material, which is, by manual force, adaptable to the geometry of the running surface of the ski at least in sections, preferably, however, over the entire length. In the mounted climbing position the climbing aid extends preferably over the entire length of the ski, so that a favorable introduction of forces in the snow surface is cared for. This embodiment of the climbing aid moreover advantageously enables efficiency increases and cost reductions in series production.

For solution of the initially indicated object the base element comprises, in accordance with one embodiment, in lateral regions backwards-slipping prevention elements with push-off wings positioned obliquely to the direction of travel and, in the central region, backwards-slipping prevention elements with push-off wings arranged substantially perpendicular to the direction of travel. Advantageously, the sliding resistance in forward direction, in particular in the case of hillside crossing, can be reduced, wherein the slipping prevention in backward direction is guaranteed by the perpendicular arrangement of the backwards-slipping prevention elements in the central region. Advantageously, the backwards-slipping prevention elements in the lateral regions are arranged in a plurality of rows obliquely to the direction of travel, wherein the backwards-slipping prevention elements in the central region are preferably also arranged in a plurality of rows, but substantially perpendicular to the direction of travel. Each row in the lateral regions and/or in the central region preferably comprises a plurality of, in particular between 2 and 10, backwards-slipping prevention elements.

In accordance with an alternative embodiment of the invention for solution of the same object the base element comprises, in lateral edge regions, backwards-slipping prevention elements of a first type and in the central region backwards-slipping prevention elements of a second type, wherein the push-off wings of the backwards-slipping prevention elements of the first type have lesser length and/or lesser height than the push-off wings of the backwards-slipping prevention elements of the second type. In correspondence with the foregoing alternative embodiment it is thus possible to achieve the common technical effect that sliding in the direction of travel is facilitated by the less pronounced backwards-slipping prevention elements at the lateral regions while slip prevention is ensured by the more pronounced backwards-slipping prevention elements in the central region.

In this embodiment it has turned out to be of advantage if the push-off wings of the backwards-slipping prevention elements in the lateral regions are arranged at an angle of 30° to 60° to the direction of travel. The angle between the obliquely positioned backwards-slipping prevention elements at the sides and the direction of travel may, for instance, substantially be 45°.

It is additionally preferred if the backwards-slipping prevention elements in the lateral regions and in the central region are designed equally, in particular substantially identically. Accordingly, this embodiment provides preferably backwards-slipping prevention elements of equal shape and size, wherein the backwards-slipping prevention elements in the lateral regions are positioned obliquely to the backwards-slipping prevention elements arranged there between.

In order to avoid sideward slipping, in particular in the case of hillside crossing, it is preferably provided that the base element comprises, in the lateral regions and/or in the central region, sidewards-slipping prevention elements which extend in the direction of travel. The sidewards-slipping prevention elements are preferably formed by longitudinal webs extending substantially in the direction of travel, i.e. in the longitudinal direction of the climbing aid. The lateral support, in particular in the case of hillside crossing, can thus be improved.

An embodiment, in which the base element is made of a polyolefin material, in particular polyethylene, is particularly preferred. The polyolefin materials have the advantage that they have a low specific weight, usually between 0.9 and 0.98 g/cm$^3$, on the one hand, and furthermore very good sliding properties on snow, and are additionally little susceptible to the formation of ice when used.

In order to achieve the slip-preventing effect of the climbing aid it is favorable if the backwards-slipping prevention elements comprise ramp elements which rise contrary to the direction of travel and which ramp elements each form a push-off wing. The push-off wings are preferably arranged at least in sections substantially perpendicular to the longitudinal plane of the climbing aid so as to achieve the holding effect on the snow surface. With respect to the shape of the ramp elements, various embodiments and modifications are conceivable in the scope of the invention. For instance, the ramp elements may be designed scale-like. The ramp elements may, however, also be elongate, wherein the ramp elements may also extend over substantially the entire breadth of the plastic support material. The push-off wings of the ramp elements may extend straightly or curved in an arc. In plan view the backwards-slipping prevention elements may, for instance, be of polygon, in particular trapezoid, design.

In tests it has surprisingly turned out to be favorable if the push-off wings have a height of 0.2 to 1 mm, in particular of 0.4 to 0.8 mm. This is because it has shown that a height of the push-off wings of less than 0.2 mm would provide too little hold during climbing, but a height of the push-off wings of more than 1 mm would result in a too strong decelerating effect.

In order to improve the slip prevention contrary to the direction of travel, it is moreover of advantage if the push-off wings form acute-angled undercuts.

In accordance with a preferred embodiment the backwards-slipping prevention elements are arranged in a plurality of rows which are preferably offset from each other. Preferably, a plurality of backwards-slipping prevention elements are provided in each row. With respect to the introduction of force into the snow surface it is favorable if the backwards-slipping prevention elements are arranged substantially over the entire length and/or breadth of the climbing aid, wherein in the mounted climbing position the climbing aid preferably covers substantially the entire running surface of the ski.

In order to facilitate the transport of the climbing aid it is favorable if the base element comprises at least two longitudinal sections which are preferably connected with each other by a respective hinge connection. In some embodiments the flexibility of the plastic support material may suffice to be able to arrange the climbing aid in a compact transport position, in particular in a folded or rolled-up position. In another embodiment the arrangement in the transport position may be facilitated by the hinge connection. The hinge connection may, for instance, be used as a folding line about which sequential longitudinal sections of the climbing aid are folded.

In accordance with a preferred embodiment the hinge connection comprises a connection element which is arranged substantially perpendicular to the longitudinal direction of the base element and which has higher flexibility than the plastic support material. In this case it is favorable if the climbing aid is produced in a 2-component injection molding process, wherein the connection element is formed by a flexible material.

In accordance with a further preferred embodiment the plastic support material, for forming the hinge connection, comprises at least one notch extending preferably over the entire breadth of the plastic support material, wherein each hinge connection preferably comprises a plurality of adjacent notches. Due to the reduction in cross section of the plastic support material in the region of the notch the swiveling capacity of the longitudinal sections relative to each other is improved. This embodiment is particularly favorable with respect to production technology.

In order to be able to arrange the climbing aid in a compact transport position it is favorable if the plastic support material comprises at least one notch on the inner side and at least one notch on the outer side, wherein preferably more than two notches are provided alternatingly on the inner side and on the outer side of the plastic support material. For storing the climbing aid, the longitudinal sections may be folded along the notches.

The swiveling capacity of the longitudinal sections relative to each other may further be achieved in that the plastic support material is underlaid with a connection layer having lower layer thickness and/or higher elasticity than the plastic support material, wherein a respective gap is formed between two longitudinal sections of the plastic support material. Accordingly, the climbing aid comprises increased flexibility in the region of the gaps between the longitudinal sections, said increased flexibility facilitating the folding of the climbing aid for transport.

In the afore-described embodiments the climbing aid in particular comprises longitudinal sections which are fixedly connected with one another. Contrary to this it is provided in accordance with a further preferred embodiment that the base element comprises at least two longitudinal sections which are connected with one another by a detachable connection. Accordingly, with this embodiment the climbing aid is of dismountable design.

In order to be able to dismount the climbing aid for transport, it is favorable if the detachable connection comprises cooperating positive locking elements which are preferably adapted to prevent detaching of the connection in the longitudinal plane of the base element and to allow detaching perpendicular thereto. The positive locking elements are preferably designed in the kind of a groove and tongue connection, wherein the cooperating positive locking elements engage in a positive locking manner in the mounted climbing position. The positive locking elements may, for instance, be formed by a projection and a matching recess. In this embodiment the longitudinal sections of the base element are preferably formed by injection molded parts.

As is per se usual with the known climbing skins, an adhesive layer for the adhesive, detachable fastening to the running surface of the ski is preferably provided as a fastening means.

In order to improve the application of the adhesive layer it is favorable if an adhesive agent layer, in particular of a fleece material, is provided between the flexible plastic support material and the adhesive layer.

If the climbing aid in the climbing position extends along the ski substantially over the entire breadth of the ski, covering the longitudinal edges of the ski, an optimum backwards-slipping prevention can surprisingly be achieved.

The object underlying the invention is additionally solved by a method, as initially mentioned, in which the base element is produced of a flexible plastic support material in which the backwards-slipping prevention elements are formed. Advantageously, savings and simplifications as compared to the relatively complex production of climbing skins can be achieved therewith.

In the method for producing the climbing aid, preferably in a first step, a film web is produced, preferably by extrusion, which is, in a second step, processed with a roller profiled in accordance with the backwards-slipping prevention elements. Depending on the profile of the roller, various shapes of backwards-slipping prevention elements can therefore be produced, so that the climbing aid can be adapted specifically to the respective requirements.

In this method it is moreover favorable if, in a first step, a film web is produced by extrusion which is connected with an adhesive agent layer, in particular of a fleece material, for the application of an adhesive layer. After the extrusion the adhesive agent layer, e.g. a fleece of plastic or glass fibers or a mesh, is applied, wherein the adhesive agent layer anchors in the melt. Thus, the adhesion between the film web and the adhesive layer can be improved. Subsequently, the backwards-slipping prevention elements can be formed by stamping with a profiled roller.

Alternatively, the base element may be produced in an injection molding process, preferably in a plurality of longitudinal sections.

DESCRIPTION OF THE INVENTION

Figure 1:
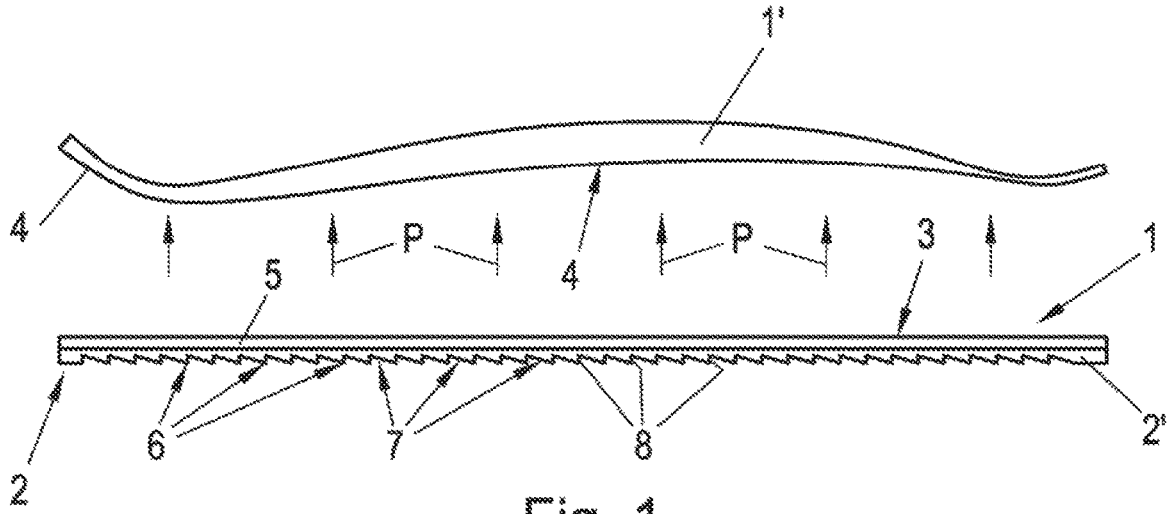
FIG. 1 is a side view of a climbing aid according to the invention to be detachably fastened to a ski, wherein the climbing aid comprises a flexible plastic support material with scale-like backwards-slipping protection elements.

FIG. 1 illustrates a climbing aid 1 to be detachably fastened to a ski 1'. The climbing aid 1 is used in ski tours so as to enable climbing over hillsides covered by snow and ice. The climbing aid 1 consists of a plane base element 2, i.e. a base element extending in the longitudinal plane, which base element is connected on the inner side to fastening means 3 to be detachably fastened to a running surface 4 of the ski 1' without a tool. In the illustrated embodiment the fastening means 3 are formed by an adhesive layer 5 which can be connected with the running surface 4 in the direction of the arrow P. In the climbing position mounted on the ski 1' (FIG. 2) the climbing aid 1 extends substantially over the entire length and substantially over the entire breadth of the ski 1', including its longitudinal edges of steel, so that the required transfer of force on the snow surface is ensured. For detaching of the climbing aid 1 the adhesive connection is released.

Figure 2:
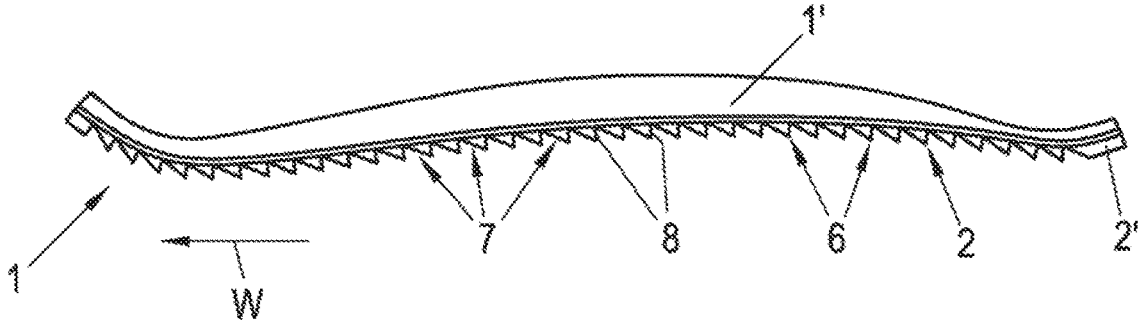
FIG. 2 is a side view of the ski with the climbing aid in the climbing position mounted on the ski.

As may further be gathered from FIGS. 1 and 2, backwards-slipping prevention elements 6 are provided on the outer side of the climbing aid 1, i.e. on the side facing the snow surface, said backwards-slipping prevention elements 6 preventing a backward slipping of the ski 1' contrary to the direction of travel W during climbing. The backwards-slipping prevention elements 6 are substantially distributed over the entire length and breadth of the climbing aid 1.

In the illustrated embodiment, a flexible plastic support material 2' is provided as a base element 2, wherein the backwards-slipping prevention elements 6 are formed integrally with the plastic support material 2'. Accordingly, the backwards-slipping prevention elements 6 are formed as a profile of the plastic support material 2'. In the illustrated embodiment the plane base element 2 with the backwards-slipping prevention elements 6 formed therein is made of the same material as the running surface 4 of the ski 1', wherein preferably a polyolefin material such as polyethylene is used.

Figure 3:
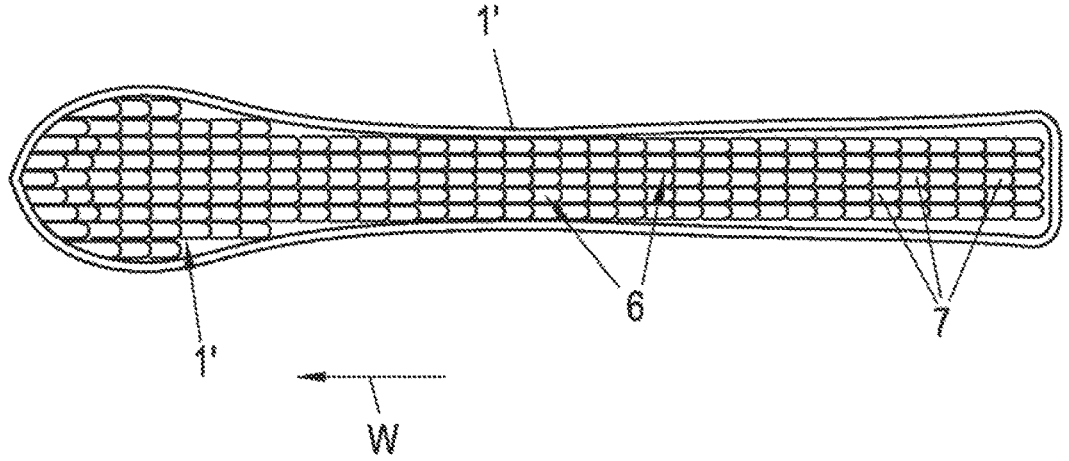
FIG. 3 is a bottom view of the ski with the climbing aid.

As may further be gathered from FIGS. 1 to 3, in the illustrated embodiment ramp elements 7 rising contrary to the direction of travel W are provided as backwards-slipping prevention elements 6, said ramp elements 7 comprising at least in sections push-off wings 8 extending obliquely to the direction of travel W. In accordance with FIGS. 1 to 3 the ramp elements 7 are of scale-like design, wherein the ramp elements 7 are arranged in a plurality of rows extending obliquely to the longitudinal direction of the climbing aid 1, each row comprising a plurality of ramp elements 7. The sheet and/or film-like plastic support material 2' is adhered to the running surface 4 in correspondence with the known climbing skins in the direction of the arrows P. In a forward movement of the ski 1' in the direction of travel W the ski 1' can slide forward, but is prevented from sliding contrary to the direction of travel W by the push-off wings 8 of the backwards-slipping prevention elements 6 which push-off wings 8 preferably extend substantially perpendicular to the plane of the ski.

Figure 4:
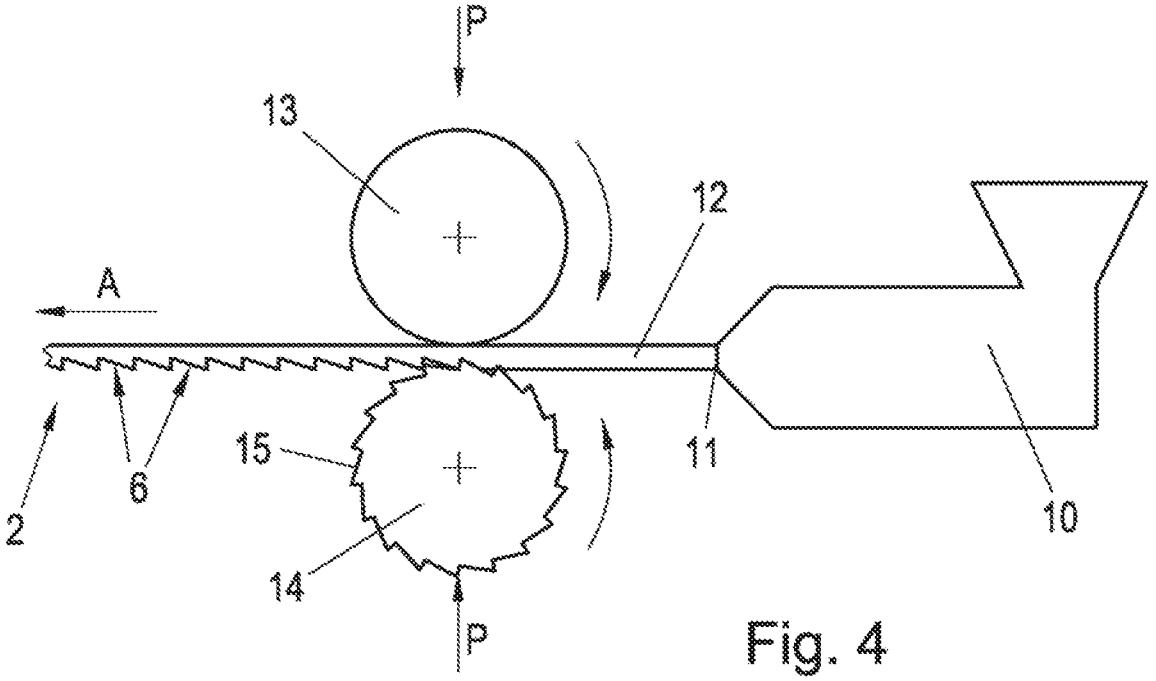
FIG. 4 is a schematic illustration of a production plant for producing the climbing aid according to the invention.

FIG. 4 schematically illustrates a production plant for producing the climbing aid 1. In an extruder 10 the plastic material is molten and subsequently pressed through a nozzle 11. In the illustrated embodiment a flat nozzle is used by means of which a sheet and/or film-like material web 12 is produced. The material web 12 is subsequently conveyed through cooperating rollers 13, 14 which are charged with a predetermined pressure P. The roller 14 is provided with a profile 15 which reproduces the profiling of the base element 2 in the negative. In engagement with the pair of rollers 13, 14 the profile 15 is pressed into the material web 12 with the pressure P, wherein the finished base element 2 consisting of the plastic support material 2' with the backwards-slipping prevention elements 6 corresponding to the profile 15 of the roller 14 is obtained.

With this simple production method it is possible to produce climbing aids 1 with various configurations of the backwards-slipping prevention elements 6, wherein FIGS. 5 to 12 illustrate strongly magnified sections of preferred embodiments of the base element 2, to which the invention is not restricted, though.

Figure 5:
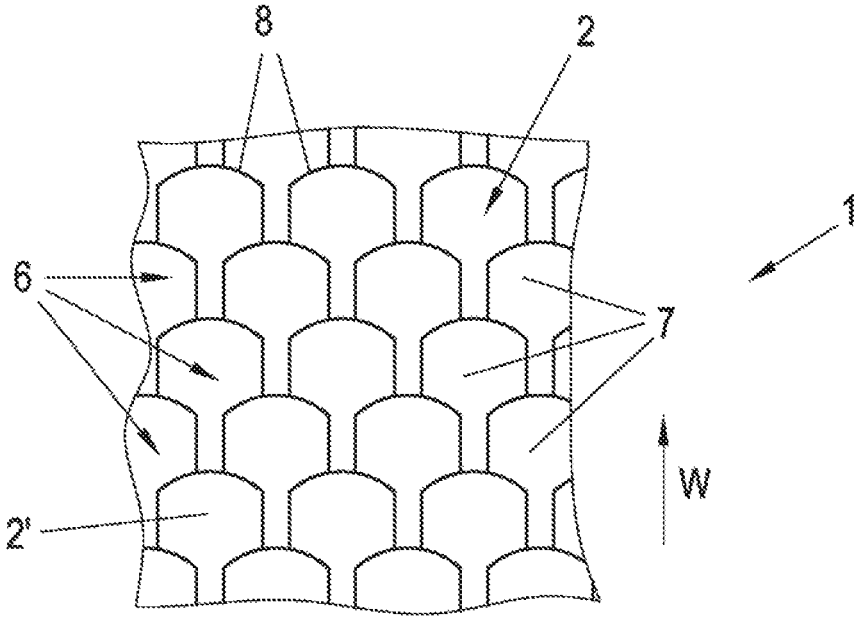
FIG. 5 is an enlarged view of a section of a further embodiment of the climbing aid in which scale-like backwards-slipping prevention elements are arranged in rows offset from each other.

In accordance with FIG. 5, scale-like, i.e. locally restricted, backwards-slipping prevention elements 6 are provided which are arranged in rows offset from each other, wherein the offset between the rows in the illustrated embodiment corresponds substantially to half the breadth of the scale-like backwards-slipping prevention elements 6. The push-off wings 8 of the backwards-slipping prevention elements 6 are curved in an arc in the illustrated embodiment.

Figure 6:
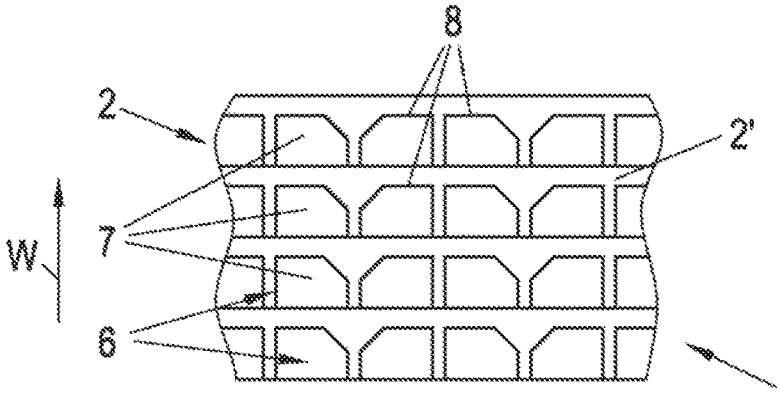
FIG. 6 is an enlarged view of a section of a further embodiment of the climbing aid in which, in plan view, approximately trapezoid backwards-slipping prevention elements are provided.

FIG. 6 illustrates an alternative embodiment of the scale-like backwards-slipping prevention elements 6 which comprise straight push-off wings 8 substantially perpendicular to the direction of travel W. In plan view, the backwards-slipping prevention elements 6 are approximately trapezoid.

Figure 7:
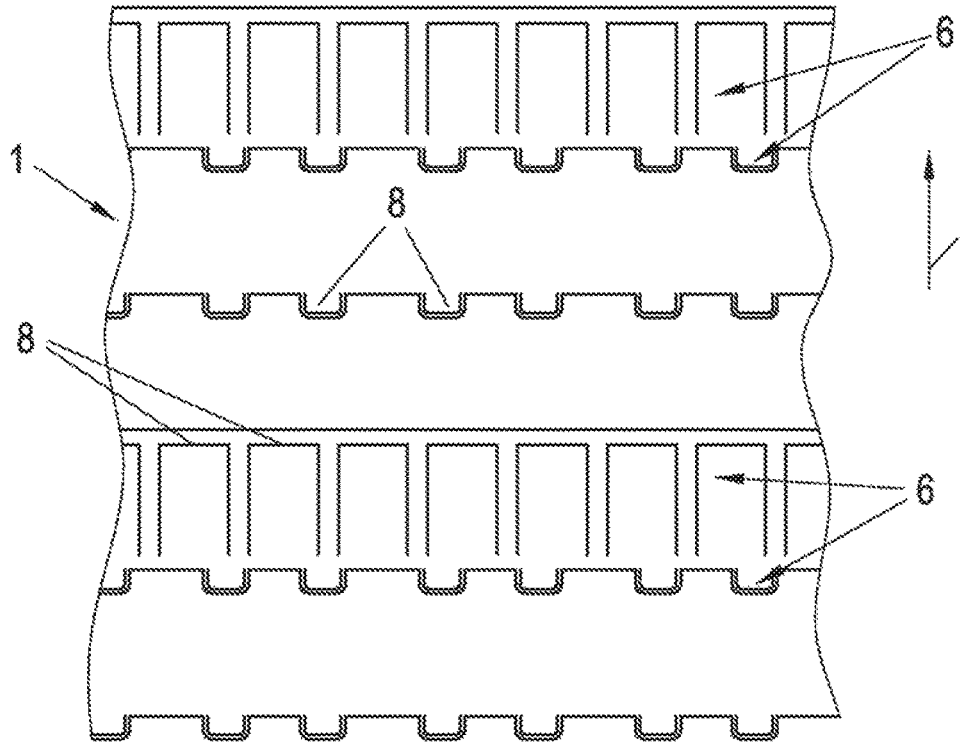
FIG. 7 is an enlarged view of a section of a further embodiment of the climbing aid with different backwards-slipping prevention elements.

In accordance with FIG. 7, backwards-slipping prevention elements 6 which are rectangular in plan view and the longitudinal sides of which are oriented in the direction of travel W, wherein the narrow sides extend perpendicular to the direction of travel W are provided on the one hand. The front narrow sides—seen in the direction of travel W—of these backwards-slipping prevention elements are designed as push-off wings 8. Moreover, further, substantially rectangular backwards-slipping prevention elements 6 are provided, wherein the push-off wings 8 are each formed on the rear longitudinal sides—seen in the direction of travel W—of these backwards-slipping prevention elements 6.

Figure 9:
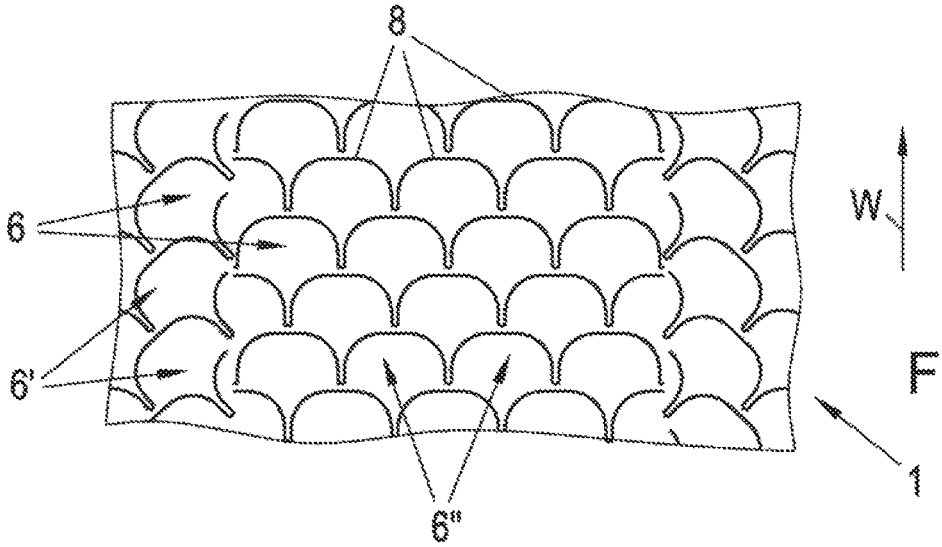
FIG. 9 is an enlarged view of a section of an embodiment of the climbing aid modified relative to FIG. 8.
Figure 8:
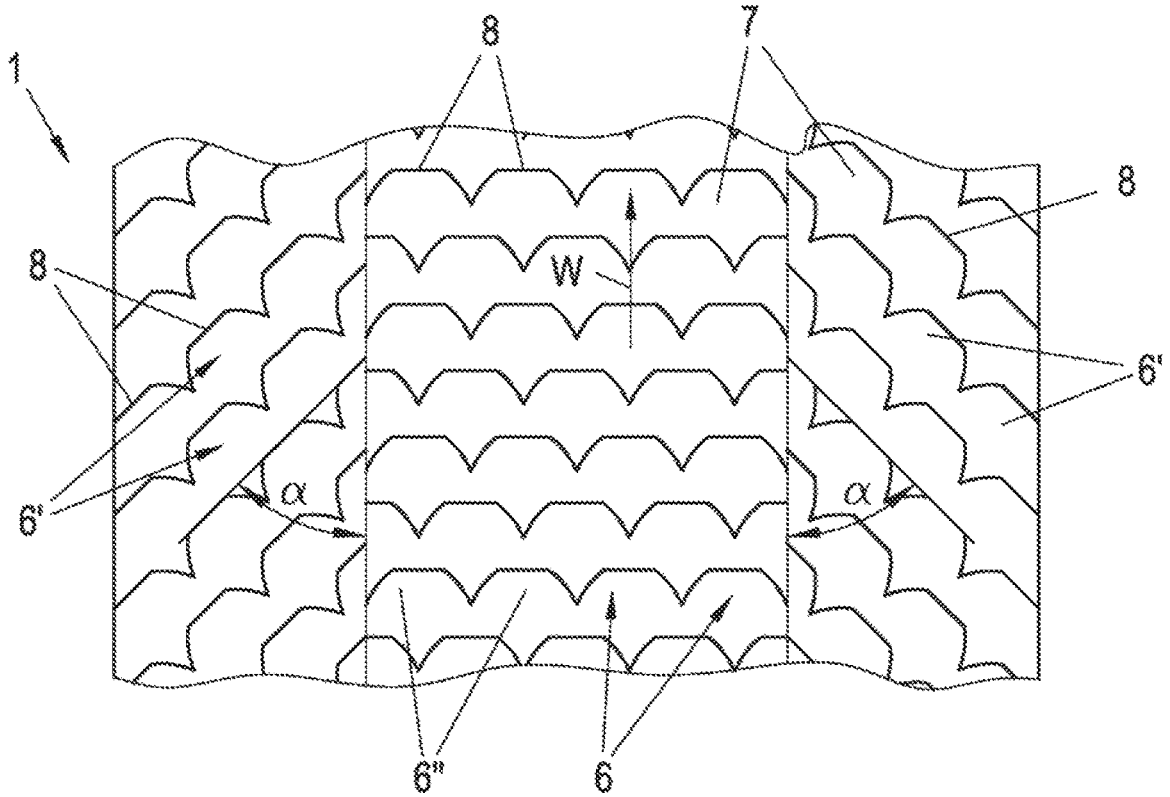
FIG. 8 is an enlarged view of a section of a further embodiment of the climbing aid in which, in the lateral regions, obliquely positioned backwards-slipping prevention elements and, in the central region, backwards-slipping prevention elements arranged perpendicular to the direction of travel are provided.

FIG. 8 illustrates a further embodiment of the climbing aid 1 in which the base element 2 comprises, in the lateral regions, i.e. adjacent to the longitudinal edges, backwards-slipping prevention elements 6' positioned obliquely to the direction of travel. The push-off wings 8 of the lateral backwards-slipping prevention elements 6' are arranged in the illustrated embodiment at an angle $\alpha$ of 45° to the direction of travel W. Moreover, in the central region between the lateral regions of the base element 2, backwards-slipping prevention elements 6" are provided which comprise push-off wings 8 arranged substantially perpendicular to the direction of travel. This kind of design has the advantage that the resistance to sliding in the direction of travel W, in forward direction, especially in the case of hillside crossing, can be reduced, but sufficient resistance to backward slipping is given by the orthogonal arrangement of the backwards-slipping prevention elements 6" in the central region. In the embodiment of FIG. 9 the backwards-slipping prevention elements 6' in the lateral regions and in the central region are of substantially identical design, wherein the backwards-slipping prevention elements 6', 6" are each arranged in a plurality of rows along the base element 2. In the illustrated embodiment the backwards-slipping prevention elements 6', 6" comprise straight push-off wings 8.

The embodiment according to FIG. 9 differs from that of FIG. 8 in particular in that the push-off wings 8 of the backwards-slipping prevention elements 6', 6" are in sections curved in an arc.

Figure 10:
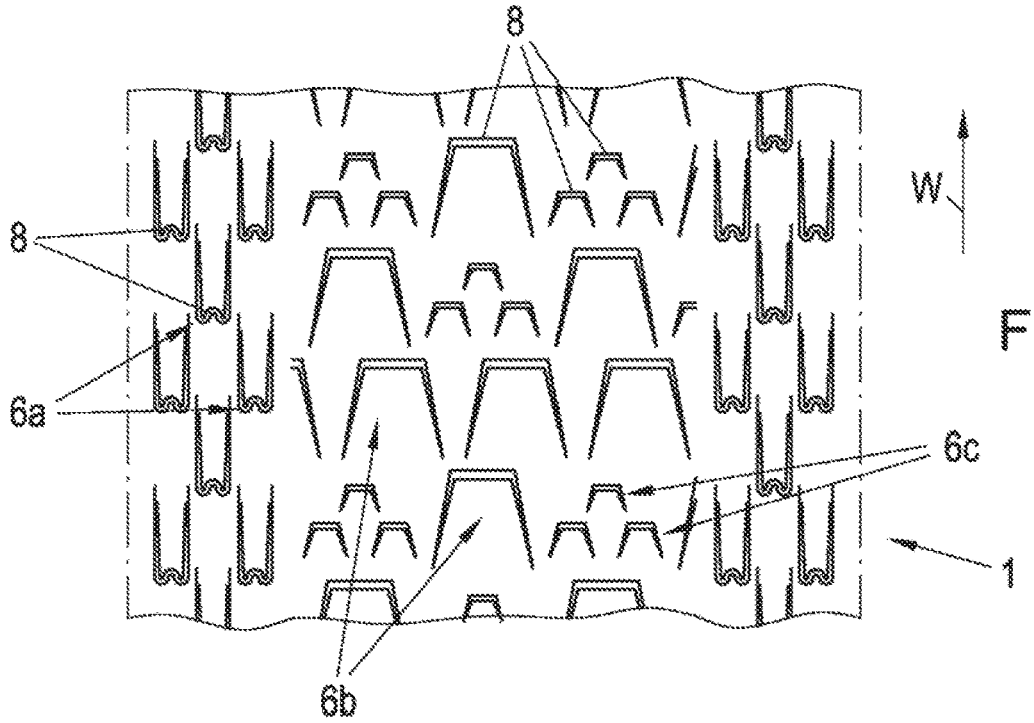
FIG. 10 is an enlarged view of a section of a further embodiment of the climbing aid in which, at the lateral edge regions, shorter and less pronounced backwards-slipping prevention elements than in the central region are provided.

In accordance with the embodiment of the climbing aid 1 illustrated in FIG. 10, the base element 2 comprises, at the two lateral regions, backwards-slipping prevention elements **6*a* of a first type and, in the central region, backwards-slipping prevention elements 6*b* at least of a second type. The push-off wings 8 of the backwards-slipping prevention elements 6*a* of the first type at the sides have lesser length and/or lesser height than the push-off wings 8 of the backwards-slipping prevention elements 6*b* of the second type. Substantially the same effect as with the embodiment pursuant to FIG. 9 can be achieved herewith. Moreover, in the illustrated embodiment, in the central region, backwards-slipping prevention elements 6*c* of a third type are provided, which correspond substantially to the backwards-slipping prevention elements 6*b* of the second type, but have smaller size. The backwards-slipping prevention elements 6*b* of the second type and/or the backwards-slipping prevention elements 6*c*** of the third type are designed in the form of symmetrical, isosceles trapezoids.

Figure 11:
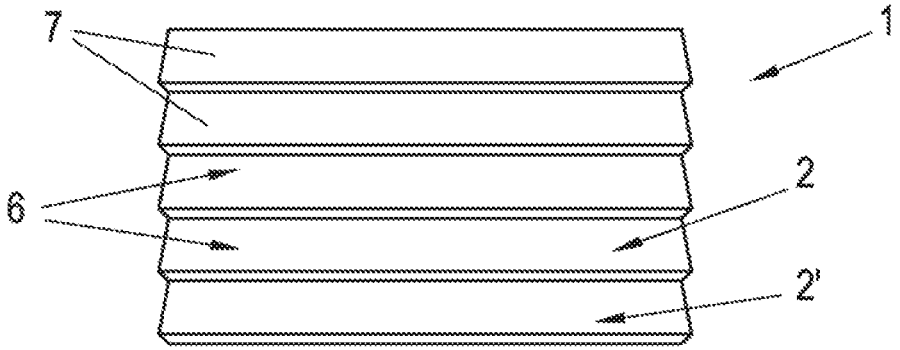
FIG. 11 is an enlarged view of a section of a further embodiment of the climbing aid with ramp-shaped backwards-slipping prevention elements which extend over the entire breadth of the climbing aid.

FIG. 11 illustrates a climbing aid 1 in plan view, in which the backwards-slipping prevention elements 6 extend in the form of ramp elements 7 along the entire breadth of the climbing aid 1. The result is a saw tooth-like profile of the base element 2.

Figure 12A:
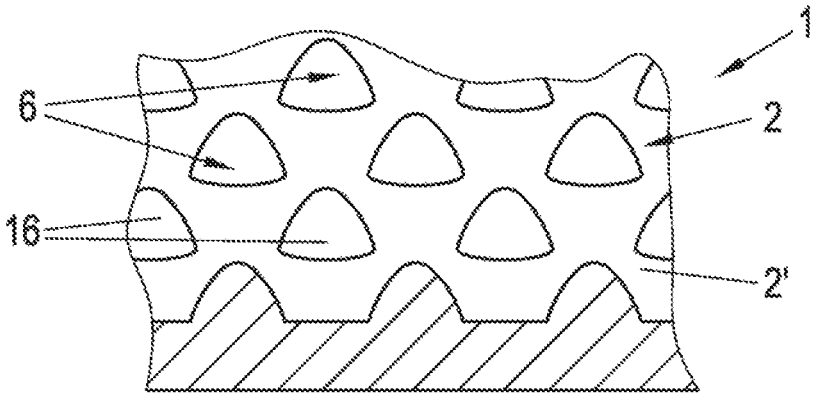
FIG. 12A is an enlarged view of a section of a further embodiment of the climbing aid with pimple-shaped backwards-slipping prevention elements.

In accordance with FIG. 12A, pimple elements 16 projecting substantially perpendicularly from the longitudinal plane of the base element 2 and arranged in rows offset from each other are provided as backwards-slipping prevention elements 6.

Figure 12B:
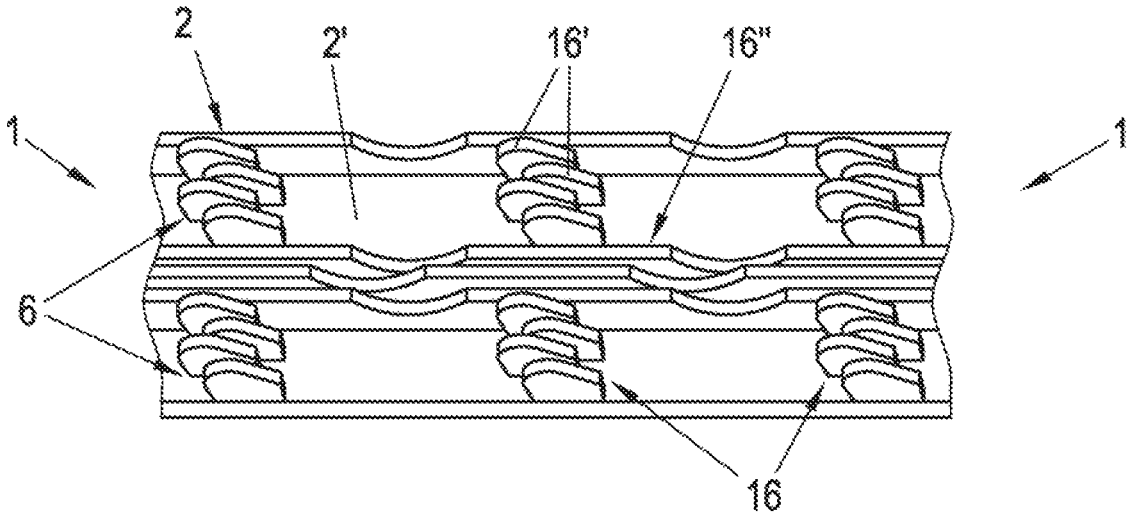
FIG. 12B is an enlarged view of a section of a further embodiment of the climbing aid with pimple elements of a different design.

FIG. 12B illustrates a climbing aid 1 with an alternative design of the pimple elements 16 which are each composed of a plurality of small plates 16' slightly offset from each other. Moreover, central webs 16" are provided which are composed of elongate small plates.

Figure 13A:
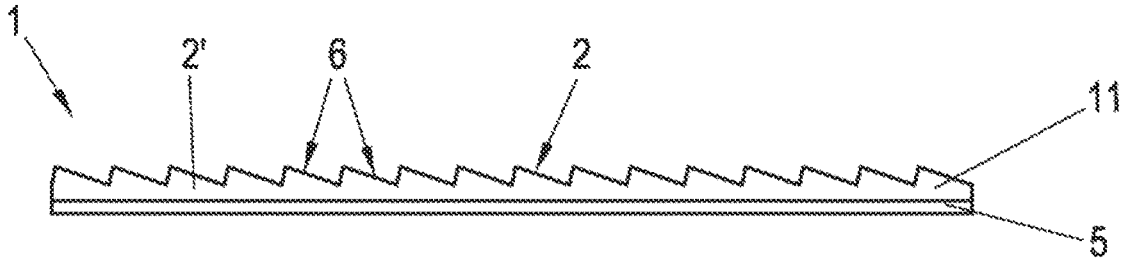
FIGS. 13A and 13B are enlarged views of the climbing aid in a condition corresponding to the climbing position on the ski (FIG. 13A) and/or in a rolled-up transport condition (FIG. 13B).
Figure 13B:
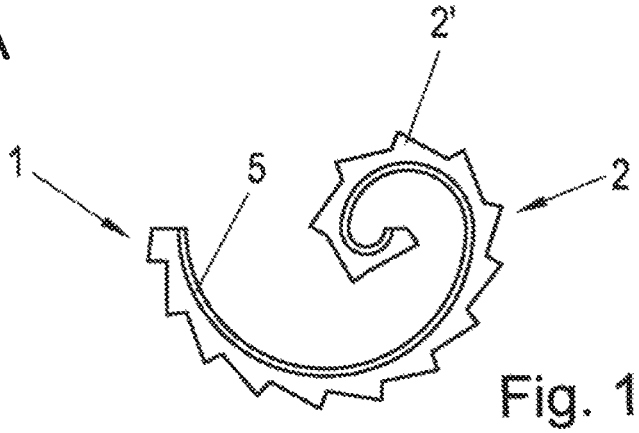

As may be gathered from FIGS. 13A, 13B for transport purposes the climbing aid 1 may be rolled up from a condition corresponding to the climbing position on the ski 1' (FIG. 13A) to a transport condition (FIG. 13B). Since the base element 2 is produced of a plastic support material 2' it is, other than with climbing skins, not necessary here that the adhesive layer 5 be covered with a separating film before the climbing aid 1 is rolled up.

Figure 14A:
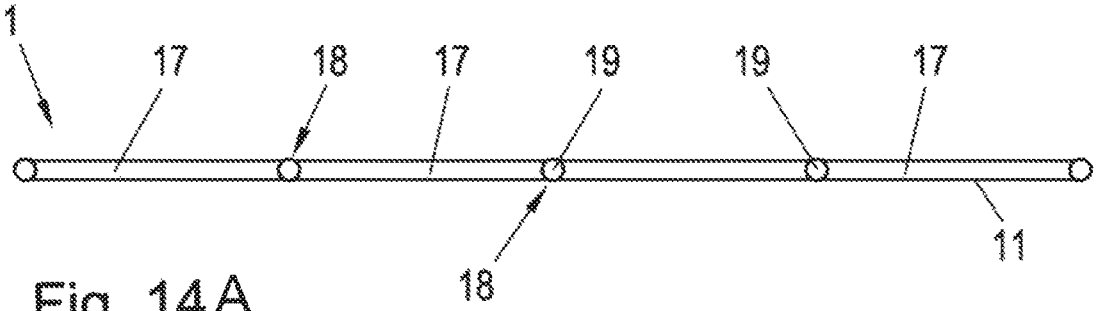
FIGS. 14A and 14B are views of a further embodiment of the climbing aid in which two longitudinal sections are provided which are connected by a hinge connection, wherein the climbing aid in FIG. 14A is illustrated in a condition corresponding to the climbing position mounted on the ski and in FIG. 14B in a folded transport condition.
Figure 14B:
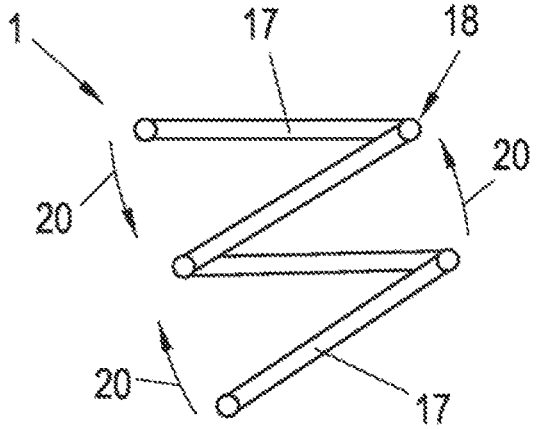

FIGS. 14A, 14B shows an embodiment of the climbing aid 1 in which the base element 2 comprises a plurality of longitudinal sections 17 which are connected with one another in pairs by a respective hinge connection 18. In accordance with FIGS. 14A, 14B, the hinge connection 18 comprises a connection element 19 arranged perpendicular to the longitudinal direction of the base element 2, said connection element 19 having higher flexibility, i.e. lower resistance to deformation, than the plastic support material 2'. For this purpose, the climbing aid 1 may be produced in the 2-component injection molding process. The longitudinal sections 17 of the climbing aid 1 can, on the one hand, be arranged in a condition corresponding to the mounting position on the ski 1', which is illustrated schematically in FIG. 14A by a plane orientation of the longitudinal sections 17. On the other hand, the climbing aid 1 may be folded along the hinge connections 18 if the climbing aid 1 is to be stored after use. FIG. 14B illustrates the folding of the longitudinal sections 17 schematically with arrows 20. In FIGS. 14A to 16 the adhesive layer 5 and the backwards-slipping prevention elements 6 are not illustrated for the sake of clarity.

Figure 15A:
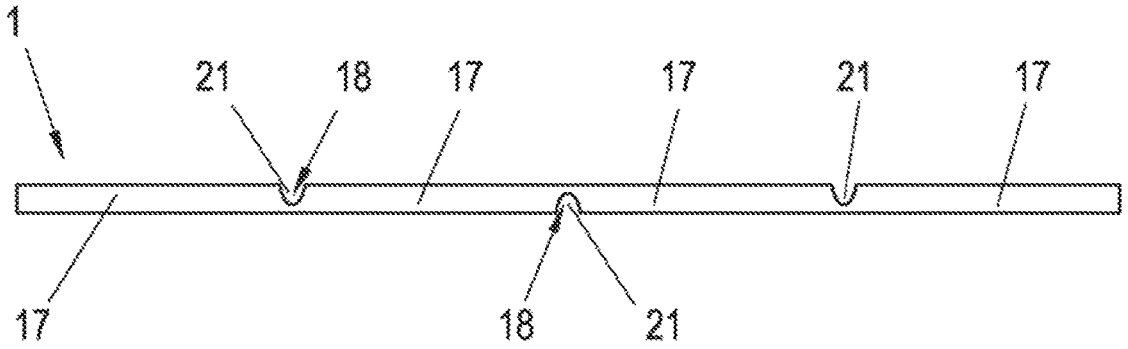
FIGS. 15A and 15*b* are views of a further embodiment of the climbing aid in which the plastic support material comprises notches alternatingly on the inner side and on the outer side, so that the climbing aid can be transitioned between a condition corresponding to the climbing position mounted on the ski (FIG. 15A) and a folded transport condition (FIG. 15B)
Figure 15B:
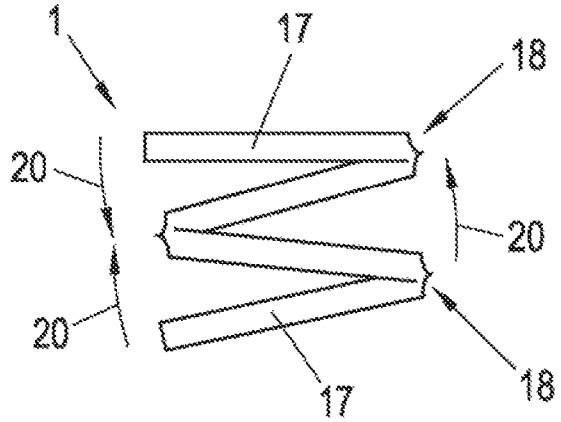

FIGS. 15A, 15B illustrate an embodiment of the climbing aid 1 in which the plastic support material 2' comprises notches 21 for forming the hinge connections 18. The notches 21 are formed by groove-shaped recesses of the plastic support material 2'. In order to improve the swiveling capacity of the longitudinal sections 17 at the notches, the notches 21 extend over the entire breadth of the plastic support material 2'. In the illustrated embodiment the notches 21 are provided alternatingly on the inner side and on the outer side of the plastic support material 2'. Due to the hinge connections 18 formed by the notches 21, the climbing aid 1 can be transferred from a condition corresponding to the climbing position, which is illustrated schematically in FIG. 15A as a plane arrangement of the longitudinal sections 17, to a folded transport condition (FIG. 15B) which is particularly suited for storing the climbing aid 1 in a backpack.

Figure 16:
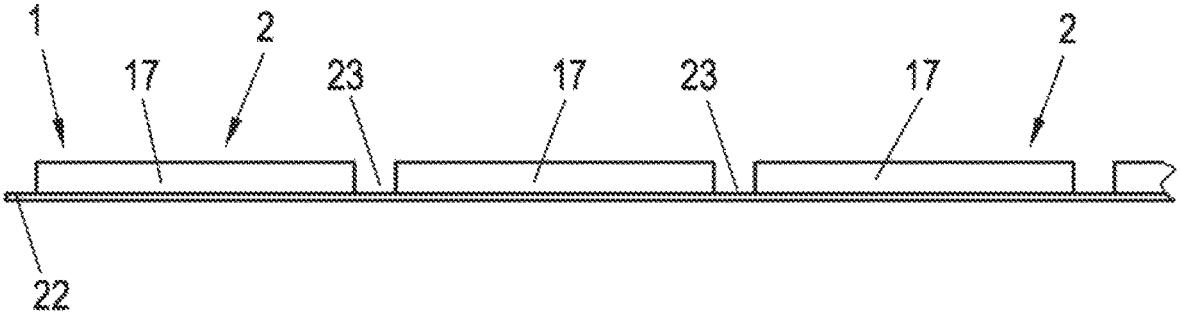
FIG. 16 is a view of a further embodiment of the climbing aid in which the longitudinal sections of the plastic support material are underlaid with a relatively thin connection layer, so that the longitudinal sections of the climbing aid are foldable at the gaps.

FIG. 16 illustrates an embodiment of the climbing aid 1 in which the plastic support material 2' is connected over the entire length with a connection layer 22 having a smaller layer thickness than the plastic support material 2'. The longitudinal sections 17 of the plastic support material 2' are arranged to be spaced by gaps 23, wherein the gaps 23 are designed as hinge connections 18 in the illustrated embodiment. In the region of the gaps 23 the climbing aid 1 has higher flexibility and/or lower resistance to deformation than in the remaining sections, so that the storing of the climbing aid 1 is facilitated by the folding of the longitudinal sections 17 along the hinge connections 18. An elastic film or a flexible mesh may, for instance, be provided as a connection layer 22, wherein, due to the spacing between the adjacent longitudinal sections 17, the foldability of the climbing aid 1 is ensured.

Figure 17:
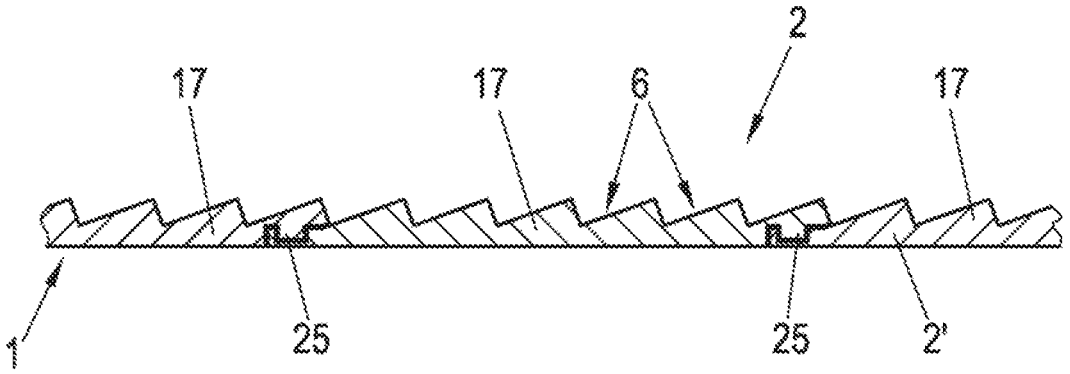
FIG. 17 is a view of a further embodiment of the climbing aid in which the longitudinal sections are connected with each other in a positive locking manner.

FIG. 17 illustrates an embodiment of the climbing aid 1 in which the longitudinal sections 17 are connected with each other by means of connections detachable without tools. The detachable connections comprise cooperating positive locking elements 25 in the kind of a groove and tongue connection which is detachable in the direction perpendicular to the longitudinal plane of the base element 2. In the connected condition, the positive locking elements 25 effect that the connection in the longitudinal plane of the base element 2 is blocked, so that unintentional detaching of the connection in use is reliably prevented. In this embodiment, the longitudinal sections 17 may be formed by injection molded parts.

Figure 18:
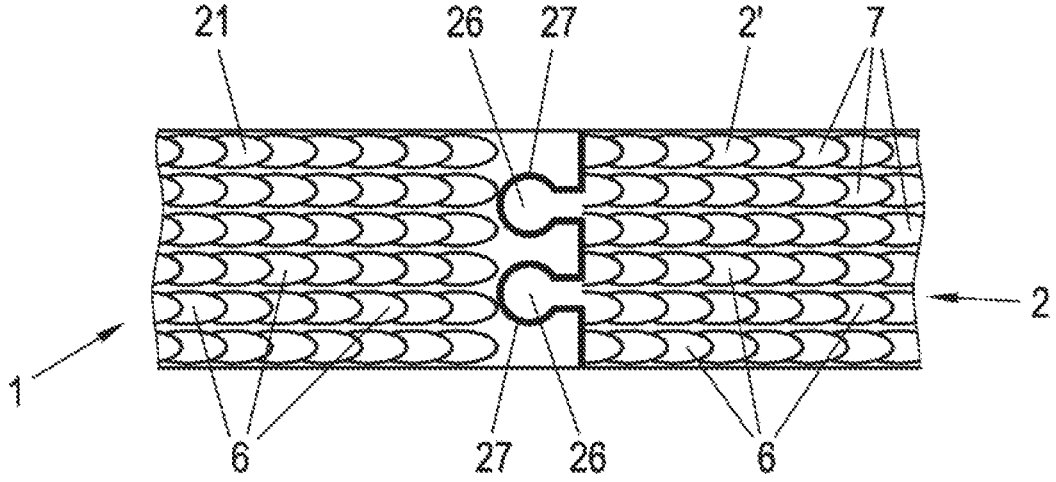
FIG. 18 is a view of an embodiment of the climbing aid which is modified with respect to FIG. 7.

FIG. 18 shows a further embodiment of the climbing aid 1 in which a detachable connection is provided between adjacent longitudinal sections 17. The detachable connection comprises as positive locking elements 25 at least one male connecting part 26 at the one longitudinal section 17 and at least one matching female connecting part 27 at the other longitudinal section 17. In the illustrated embodiment connecting parts 26, 27 are punched from the plastic support material 2'.

Figure 19:
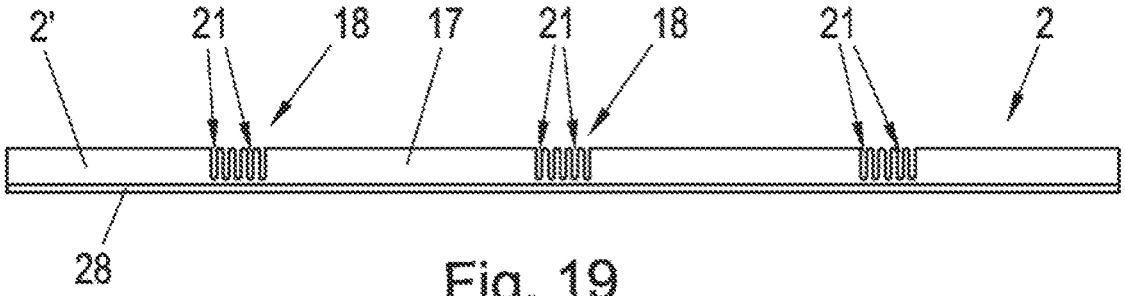
FIG. 19 is a view corresponding substantially to FIG. 15A, wherein, however, a plurality of narrower notches are provided for forming the hinge connection.

FIG. 19 illustrates a modification of the embodiment of FIG. 15A in which a plurality of narrower notches 21 are provided for forming the hinge connections 18. FIG. 19 additionally shows schematically an adhesive agent layer 28, in particular of a fleece material, which is provided on the underside of the flexible plastic support material 2' which faces the running surface of the ski 1', so as to improve the application of the adhesive. The adhesive agent layer 28 is preferably applied after the extrusion of the film web forming the plastic support material 2'.

Figure 20:
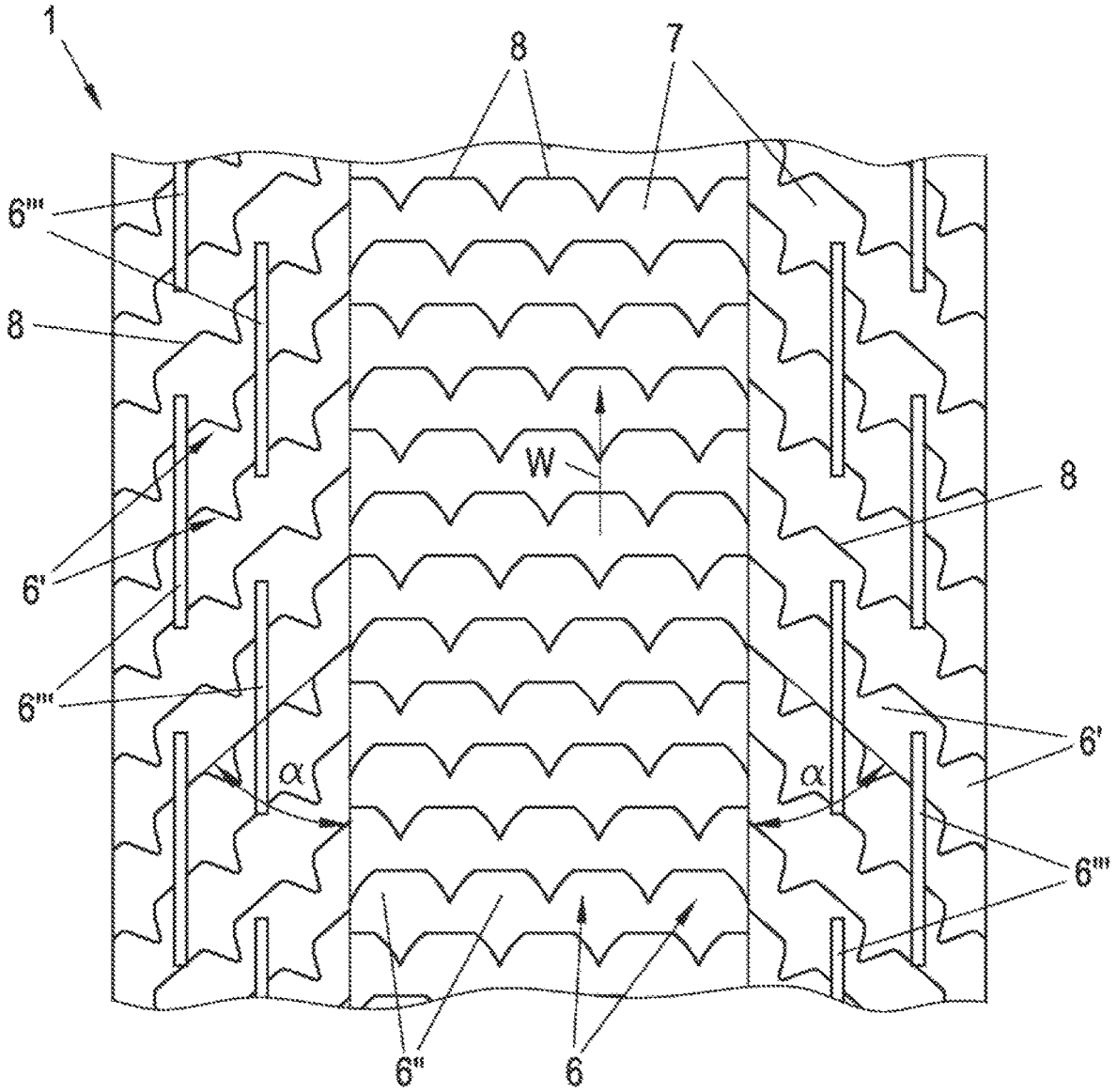
FIG. 20 is a view corresponding substantially to FIG. 8, wherein longitudinal sidewards-slipping prevention elements are additionally provided in the lateral regions.

FIG. 20 illustrates a modification of the embodiment pursuant to FIG. 8 in which the base element 2 comprises, in the lateral regions, sidewards-slipping prevention elements 6''' in the form of narrow longitudinal webs which extend in the direction of travel W. This embodiment has turned out particularly advantageous for hillside crossing. The longitudinal webs overlap the backwards-slipping prevention elements 6. In the illustrated embodiment the base element 2 comprises, in the lateral regions, two respective rows of sidewards-slipping prevention elements 6''' offset in the direction of travel W.

The invention claimed is:

1. A climbing aid for a ski, the climbing aid comprising:

a fastening device;

a plane base element connected on an inner side to said fastening device in order to be detachably fastened to a running surface of the ski, said plane base element having an outer side with backwards-slipping prevention elements acting contrary to a direction of travel, said plane base element formed from a flexible plastic support material with a flexibility allowing the climbing aid to be arranged in a folded or rolled-up position, said backwards-slipping prevention elements are integrally formed in said flexible plastic support material, said plane base element containing lateral regions having said backwards-slipping prevention elements with push-off wings positioned obliquely to the direction of travel and, in a central region, having said backwards-slipping prevention elements with said push-off wings disposed substantially perpendicular to the direction of travel; and said plane base element, in at least one of said lateral regions or in said central region, has side wards-slipping prevention elements extending in the direction of travel, said side wards-slipping prevention elements being longitudinal webs extending in the direction of travel.

2. The climbing aid according to claim 1, wherein said push-off wings of said backwards-slipping prevention elements in said lateral regions are disposed at an angle of 30° to 60° to the direction of travel.

3. The climbing aid according to claim 1, wherein said backwards-slipping prevention elements in said lateral regions and in said central region are of identical design.

4. The climbing aid according to claim 1, wherein said plane base element is manufactured of a polyolefin material.

5. The climbing aid according to claim 1, wherein said backwards-slipping prevention elements have ramp elements rising contrary to the direction of travel and each forming one of said push-off wings.

6. The climbing aid according to claim 1, wherein said push-off wings have a height of 0.2 to 1 mm.

7. The climbing aid according to claim 1, wherein said push-off wings form acute-angled undercuts.

8. The climbing aid according to claim 1, wherein said backwards-slipping prevention elements are disposed in a plurality of rows which are offset from each other.

9. The climbing aid according to claim 1, wherein said plane base element contains a hinge connection and at least two longitudinal sections which are connected with each other by said hinge connection.

10. The climbing aid according to claim 9, wherein said hinge connection has a connection element disposed substantially perpendicular to a longitudinal direction of said plane base element, said connection element having a higher flexibility than said flexible plastic support material.

11. The climbing aid according to claim 9, wherein said hinge connection is formed from said flexible plastic support material, said hinge connection has at least one notch formed therein and extending over an entire breadth of said plastic support material.

12. The climbing aid according to claim 11, wherein said flexible plastic support material has at least one notch formed therein on said inner side and at least one notch formed therein on said outer side.

13. The climbing aid according to claim 9, further comprising a connection layer, said flexible plastic support material is under laid with said connection layer having at least one of a lower layer thickness or a higher elasticity than said flexible plastic support material, wherein a respective gap is formed between said two longitudinal sections of said flexible plastic support material.

14. The climbing aid according to claim 9, wherein said plane base element has a detachable connection and said at least two longitudinal sections are connected with each other by said detachable connection.

15. The climbing aid according to claim 14, wherein said detachable connection has cooperating form locking elements which are adapted to prevent detaching of said detachable connection in a longitudinal plane of said plane base element and to allow detaching perpendicular thereto.

16. The climbing aid according to claim 1, wherein said fastening device is an adhesive layer for an adhesive, detachable fastening to the running surface of the ski.

17. The climbing aid according to claim 16, further comprising an adhesive agent layer disposed between said flexible plastic support material and said adhesive layer.

* * * * *